US008207900B1

(12) United States Patent
Apgar

(10) Patent No.: US 8,207,900 B1
(45) Date of Patent: Jun. 26, 2012

(54) APERATURE ICE INHIBITION

(75) Inventor: Brian P. Apgar, Mt. Laurel, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 419 days.

(21) Appl. No.: 12/579,880

(22) Filed: Oct. 15, 2009

(51) Int. Cl.
*H01Q 1/02* (2006.01)

(52) U.S. Cl. ..... 343/704; 343/840

(58) Field of Classification Search ..... 343/704, 343/840
See application file for complete search history.

(56) References Cited

U.S. PATENT DOCUMENTS 2,712,604 A 7/1955 Thomas, Jr. et al.
4,999,639 A 3/1991 Frazita et al.
5,010,350 A * 4/1991 Lipkin et al. ..... 343/704
5,229,779 A 7/1993 du Mesnildot
6,064,344 A * 5/2000 Walton ..... 343/704
6,194,685 B1 * 2/2001 Rutherford ..... 219/201

* cited by examiner

*Primary Examiner* — Dieu H Duong
(74) *Attorney, Agent, or Firm* — Howard IP Law Group, PC

(57) ABSTRACT

An ice-inhibition system for a communications or a radar antenna having an aperture includes a membrane placed before the antenna aperture and secured to the antenna along the antenna's perimeter. The membrane has one or more membrane excitation points identified thereon and when an outward membrane excitation force is delivered to the one or more excitation points, a shock wave is generated at each of the one or more membrane excitation points and propagates away from the membrane excitation points along the membrane toward the perimeter region removing any ice crystals formed on the outer surface of the membrane.

15 Claims, 7 Drawing Sheets

APERATURE ICE INHIBITION

CROSS-REFERENCE TO RELATED APPLICATION

None

FIELD OF THE INVENTION

This disclosure relates generally to an ice inhibiting system for a radar or a communications antenna.

BACKGROUND

Antenna aperture performance for both transmitting and receiving the Radio Frequency (RF) signals is diminished when covered by ice. The impact is exacerbated by the water associated with melting ice. On many planer naval antenna installations, the current solutions employ a matrix of heating element(s) in the antenna structure to heat the exterior surface above freezing to inhibit the formation of ice. Such a solution, however, requires significant electrical energy. In newer antenna systems employing composite radomes made of quartz or fiberglass skins that contain a frequency selective surface, the configuration of the radome does not allow conduction of heat from the antenna structure to the outer surface of the radome.

Thus, there is a need for a simple, effective and cost efficient way of preventing the ice build up on exterior communication and radar antennas.

SUMMARY

According to an embodiment of the disclosure, an ice-inhibition system for a communications or a radar antenna is disclosed. The ice-inhibition system is comprised of a membrane provided in front of an aperture of the antenna. The membrane is secured to the antenna along the antenna's perimeter region. One or more membrane excitation points are pre-identified on the membrane and when a membrane excitation force is delivered to the one or more membrane excitation points, a shock wave is generated at each of the one or more membrane excitation points and propagates along the membrane. The propagating shock wave(s) from each of the one or more membrane excitation points remove any ice crystals that may have formed on the outer surface of the membrane.

According to another embodiment, the ice-inhibition system further includes a means for providing the membrane excitation force to the one or more excitation points on the membrane.

Thus, the disclosed ice-inhibition system provides easy and effective method to prevent the accumulation of ice on a communications or radar antenna aperture. The ice-inhibition system described herein eliminates the need for the use of any heating elements for raising the exterior surface temperature above freezing. The elimination of the heating elements provides (1) significant reduction of power required to operate the antenna; (2) eliminates any disturbances and interferences to the RF energy (signals) caused the heating elements which degrades the aperture performance; and (3) eliminates any limitations of the aperture to a single polarization imposed by the polarizing filter effect of the heating element(s). Additionally, because the ice-inhibition system of the present disclosure does not require the use of heating elements, the Infrared (IR) signature of the antenna aperture is reduced.

BRIEF DESCRIPTION OF THE DRAWINGS

These and other features and advantages of the present invention will be more fully disclosed in the following detailed description of a preferred embodiment of the invention, which is to be considered together with the accompanying drawings.

The features shown in the above referenced drawings are illustrated schematically and are not intended to be drawn to scale nor are they intended to be shown in precise positional relationship. Like reference numbers indicate like elements.

DETAILED DESCRIPTION

Figure 1:
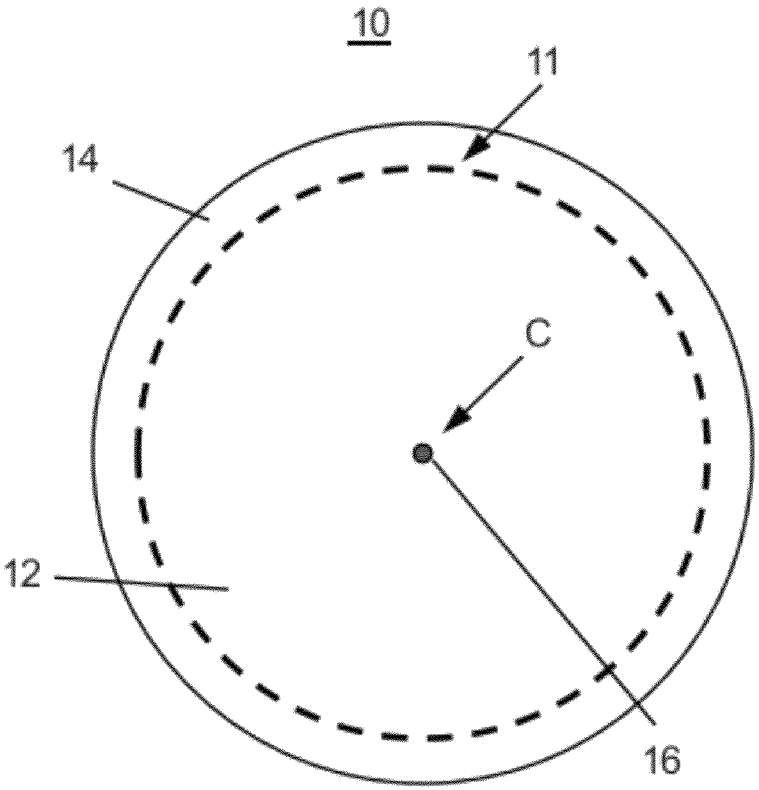
FIG. 1 is a front view of an antenna provided with a ice-inhibition membrane according to an embodiment.

This description of the preferred embodiments is intended to be read in connection with the accompanying drawings, which are to be considered part of the entire written description of this invention. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, such as "attached," "attaching," "mounted," and "mounting" are used interchangeably and refer to one structure or surface being secured to another structure or surface, unless expressly described otherwise.

Antenna "aperture" as used herein refers to the area defined by the perimeter region of the antenna constructed broadside to incoming and/or outgoing radiation where all radiation passing within the aperture is delivered to and/or by the antenna. The shape of the antenna and the corresponding aperture shown in this application are only a few examples and the present invention is applicable to other possible planar antenna and aperture shapes, including but not limited to circle, rectangle, diamond, hexagon, octagon, etc. Further, this embodiment could be applied to non-planar apertures.

FIG. 1 shows a front view of a circular shaped radar antenna 10 provided with an ice-inhibition system for a radar or a communications antenna having an aperture 11 according to an embodiment of the present disclosure. The ice-inhibition system includes an ice-inhibition membrane 12 provided in front of the aperture 11 of the radar antenna 10. The membrane 12 is secured to the antenna 10 along the antenna's perimeter region 14. The aperture 11 is behind the membrane 12 and thus the broken line illustrates the outline of the aperture 11. The membrane 12 can be bonded to the perimeter region 14 of the antenna using an appropriate adhesive material or attached to the antenna by an appropriate mechanical means that would be readily accessible to one of ordinary skill in the art.

In this embodiment, one membrane excitation point 16 is pre-identified on the membrane 12 and the system can include a means 50 (see FIG. 3) for providing membrane excitation force to the membrane excitation point 16. Some examples of such means for providing a membrane excitation force are: a direct mechanical means (such as a piston or a hammer) that delivers an impact force outward to the membrane 12 at the membrane excitation point 16; a pressurized air pulse delivered under the membrane from a port at the membrane excitation point 16; an acoustic energy pulse (e.g. low frequency noise) delivered under the membrane from a source/port at the membrane excitation point 16; or a combination of air pulse and acoustic energy pulse delivered under the membrane excitation from a port at point 16.

Figure 2A:
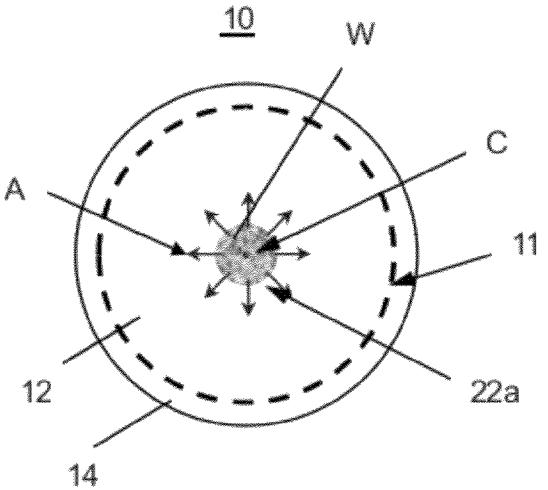
FIGS. 2A-2C are time sequence front views of the antenna aperture of FIG. 1 showing the propagation of a shock wave W in the ice-inhibition membrane on the antenna aperture.
Figure 2B:
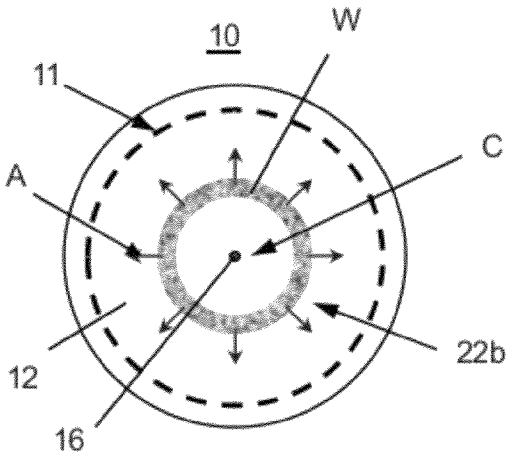
Figure 2C:
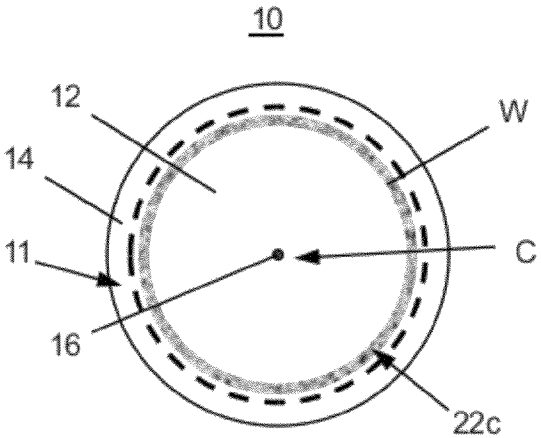

A membrane excitation force delivered to the membrane excitation point 16 will generate a shock wave that propagates along the membrane 12 and remove any ice crystals that have accumulated on the surface of the membrane 12. As one would expect, the pattern or the shape of the propagating wave front of the shock wave along the membrane 12 will depend on the particular shape and configuration of the antenna aperture 11 as well as the locations of the one or more membrane excitation points 16 on the membrane 12. For example, if a membrane excitation point 16 were near the center of the membrane 12, the shock wave generated at the excitation point 16 would radially propagate from the membrane excitation point 16 towards the periphery of the membrane 12 regardless of the particular shape of the antenna aperture 11. This type of shock wave front propagation is shown in the time sequence illustrations of FIGS. 2A-2C of an example of an embodiment of an antenna aperture. FIG. 2A schematically shows the shock wave W in its initial position 22*a* initiating at the membrane excitation point 16 and begin to radially propagate away from the excitation point 16 and toward the periphery 15 of the membrane 12 as noted by the arrows A. FIG. 2B shows the shock wave W in its intermediate position 22*b* between the membrane excitation point 16 and the perimeter region 14 of the membrane 12 as the shock wave W propagates along the membrane. FIG. 2C shows the shock wave W near its final position 22*c* near the outer edge 15 of the membrane 12.

Figure 3:
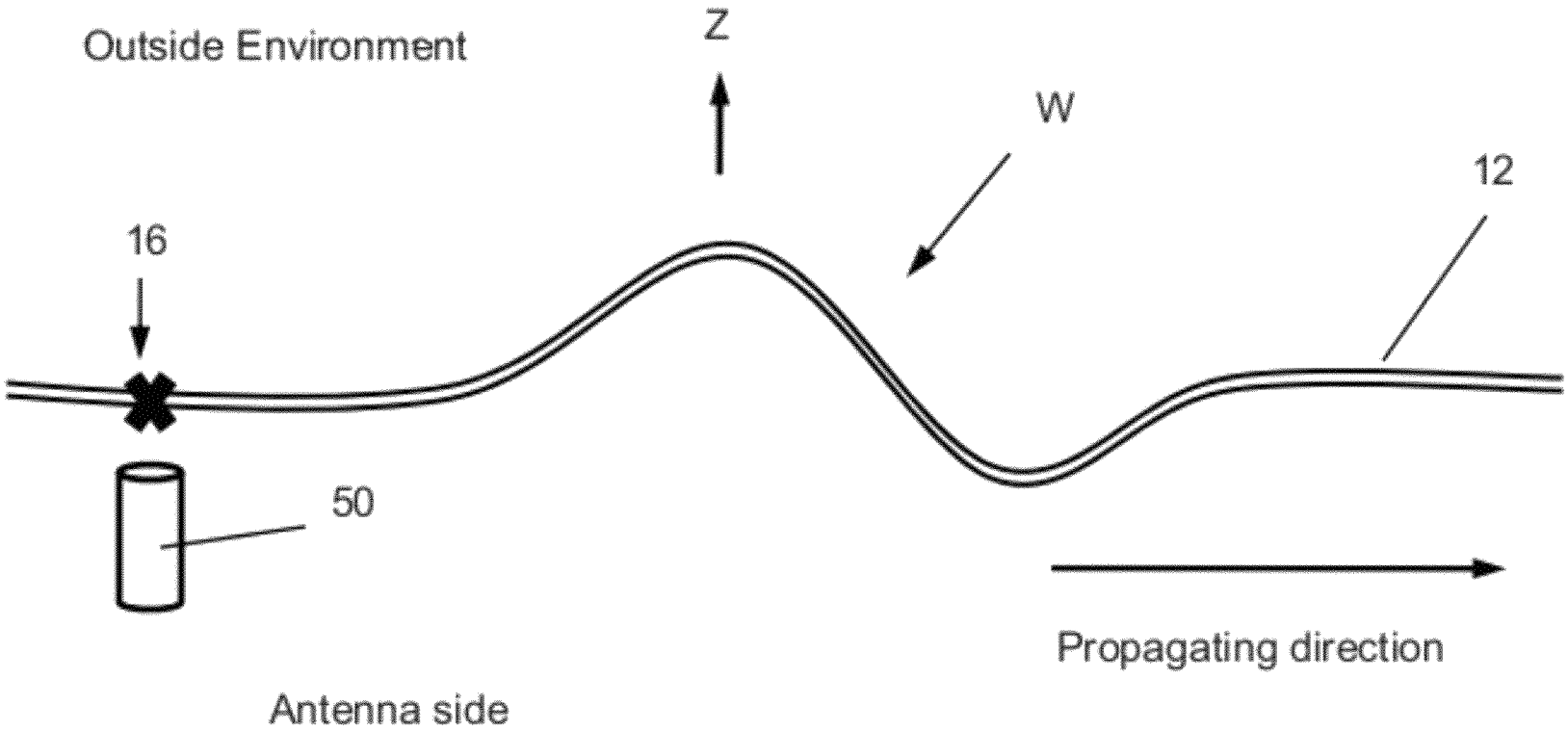
FIG. 3 shows a cross-sectional view of the ice-inhibition membrane illustrating the shock wave W propagating along the membrane.

FIG. 3 shows a cross-sectional view of the membrane 12 illustrating a shock wave W propagating away from the excitation point 16 along the membrane 12. The means 50 for providing outward membrane excitation force is shown behind the membrane excitation point 16 as previously described, the excitation may be direct contact of the membrane by mechanical means or indirect contact by pneumatic, acoustic or a combination of both. As the shock wave W propagates, the membrane 12 is locally displaced in orthogonal direction Z and dislodges any ice crystals formed on the surface of the membrane 12.

Figure 4:
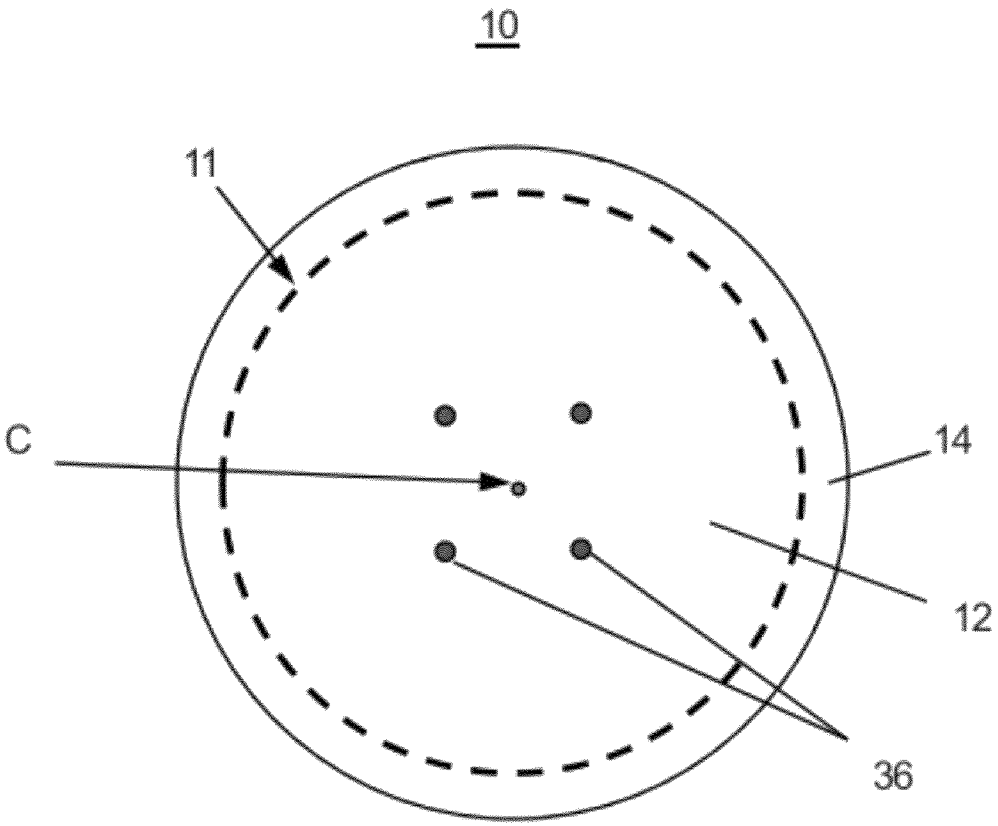
FIG. 4 is a front view of an antenna aperture according to another embodiment.

FIG. 4 shows a front view of the antenna 10 provided with an ice-inhibition system according to another embodiment of the present disclosure. The ice-inhibition system of this embodiment includes a membrane 12 provided in front of the aperture 11 of the antenna 10. The membrane 12 is secured to the antenna 10 along the antenna's perimeter region 14.

In this embodiment, the membrane 12 includes a plurality of membrane excitation points 36 pre-identified on the membrane 12. As in the first embodiment, the system includes a means for providing outward membrane excitation force at each of the membrane excitation points 36.

A membrane excitation force delivered to each of the membrane excitation points 36 will generate a shock wave at each of the membrane excitation points 36 that radially propagate outward from their respective membrane excitation points along the membrane 12. Similar to the embodiment shown in FIGS. 2A-2C, the shock waves will propagate from each of the membrane excitation points 36 toward the periphery of the membrane 12 and remove any ice crystals that accumulate on the surface of the membrane 12. In one preferred embodiment, the membrane excitation force is delivered to each of the four membrane excitation points 36 simultaneously.

Figure 5A:
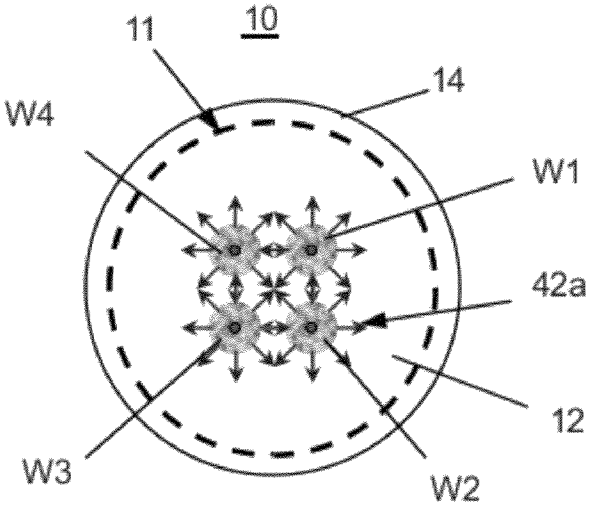
FIGS. 5A-5C are time-sequence front views of the antenna aperture of FIG. 4 showing the propagation of a shock waves in the membrane on the antenna aperture.
Figure 5B:
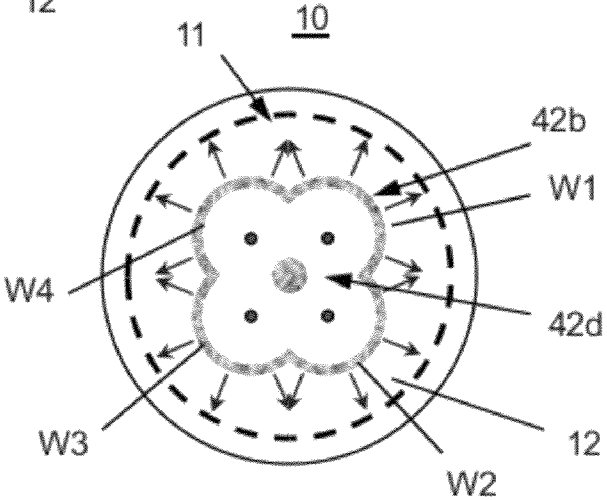
Figure 5C:
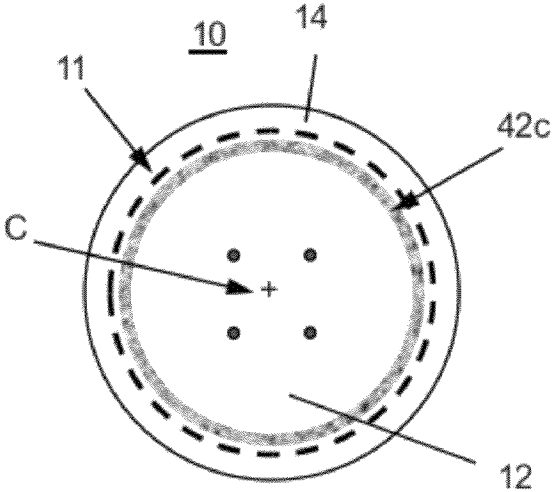

The time sequence illustrations of FIGS. 5A-5C illustrate this in more detail. In this embodiment, four membrane excitation points 36 are pre-identified for the membrane 12. The four membrane excitation points 36 are located radially symmetric about the geometric center C of the antenna aperture 11. FIG. 5A schematically shows the shock waves W1, W2, W3 and W4 in their initial positions 42*a* initiating at the membrane excitation points 36 and begin to radially propagate along the membrane 12 as shown by the arrows. FIG. 5B shows the shock waves W1, W2, W3 and W4 in their intermediate states 42*b* and 42*d* between the membrane excitation points 36 and the perimeter region 14 as the shock waves propagate along the membrane 12. As the shock waves propagate outward from their respective membrane excitation points 36, the shock waves merge. As shown by the intermediate state 42*d*, a portion of the shock waves merge at the center C of the antenna aperture 11, while other portions of the shock waves merge and continue to propagate outward as a single composite shock wave (as illustrated by the intermediate state 42*b*). FIG. 5C shows the composite of the shock waves near its final position 42*c* near the outer edge 15 of the membrane 12.

According to a preferred embodiment, the means 50 for providing the membrane excitation force from underneath the membrane 12 can be configured to have one or more vent holes to allow any air entrapped between the membrane 12, 32 and the antenna 10 to escape.

In the examples illustrated in FIGS. 1 through 5C, the shape of the antenna 10 has a circular shape for the sake of simplifying the example. But, the ice-inhibition system of the present disclosure is equally applicable to antennae having a variety of shapes. For example, the antenna 10 and its aperture 11 can have an oval, square, diamond or any polygon shape.

Figure 6:
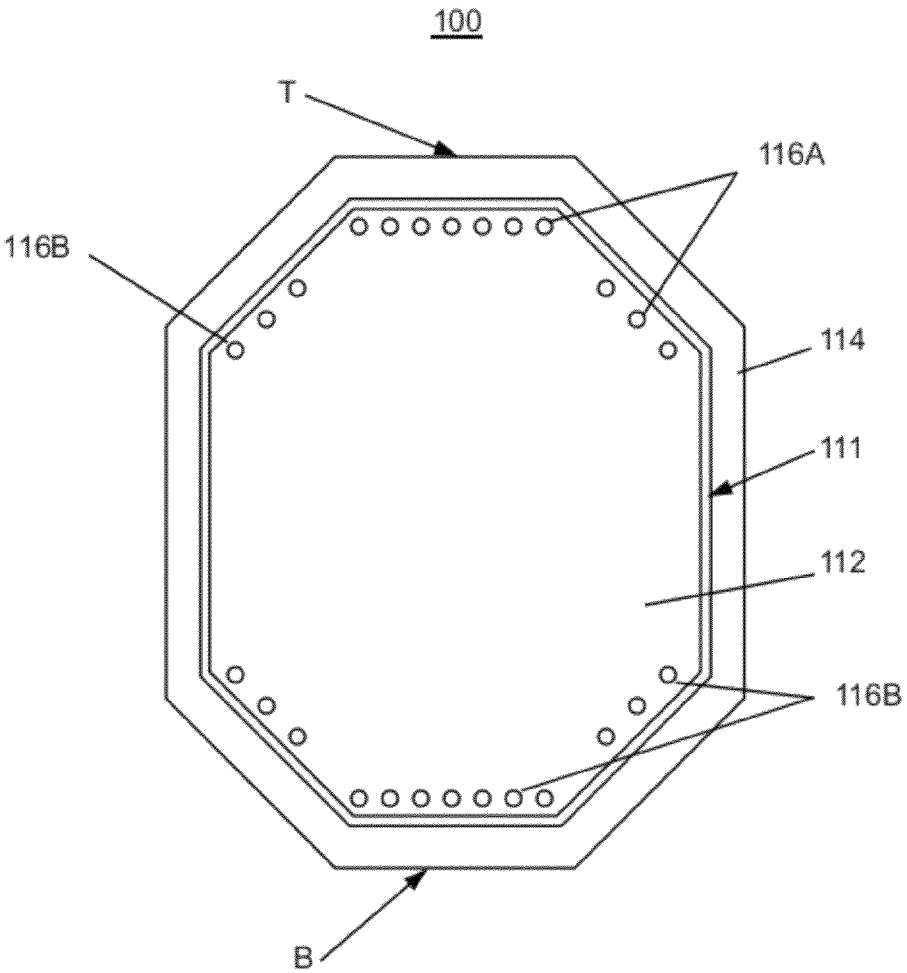
FIG. 6 is a front view of an antenna aperture according to another embodiment.

FIG. 6 shows an antenna 100 according to another embodiment on which an ice-inhibition system of the present disclosure is implemented. The antenna 100 has a more complex polygonal shape. The antenna 100 has an aperture 111 and a membrane 112 is provided in front of the antenna aperture 111. The membrane 112 is secured to the antenna 100 along the antenna's perimeter region 114. The membrane 112 can be bonded to the perimeter region 114 using an appropriate adhesive material or by an appropriate mechanical means that would be readily accessible to one of ordinary skill in the art.

In this embodiment, the ice-inhibiting system is configured to produce a shock wave that starts from a first end T of the antenna aperture 111 and propagates along the membrane 112 to an opposing second end B. As the shock wave propagates and sweeps across the membrane 112, any ice crystals that are formed on the outer surface of the membrane 112 are removed.

One example of such ice-inhibiting system includes a first set of one or more membrane excitation points 116A identified on the membrane 112 near the first end T of the antenna aperture 111. In one preferred embodiment, the one or more membrane excitation points 116A are provided near the periphery of the aperture 111.

Figure 7A:
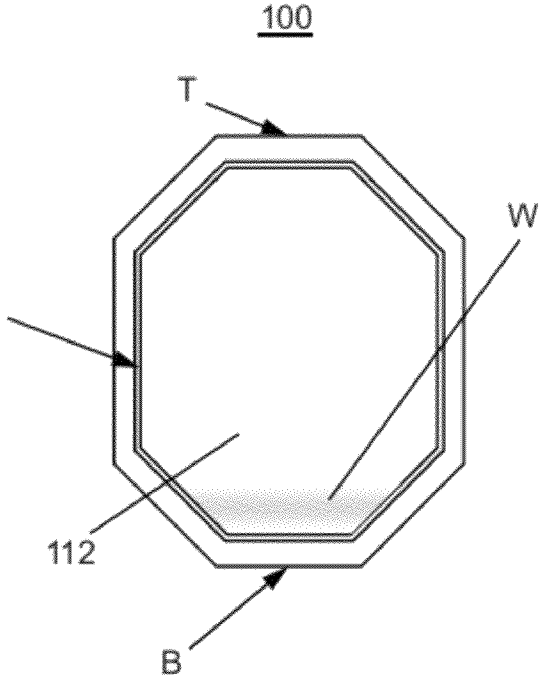
FIGS. 7A-7C are time-sequence front views of the antenna aperture of FIG. 6 showing the propagation of a shock wave in the membrane on the antenna aperture.

When a membrane excitation force is applied to the first set of one or more membrane excitation points 116A, a shock wave is generated at each of the one or more membrane excitation points 116A and form a composite shock wave front W as shown in FIG. 7A. Because the first set of one or more membrane excitation points 116A are located near the perimeter of the antenna aperture 111 near the first end T, the composite shock wave front W travels towards the second end B along the membrane 112.

Figure 7B:
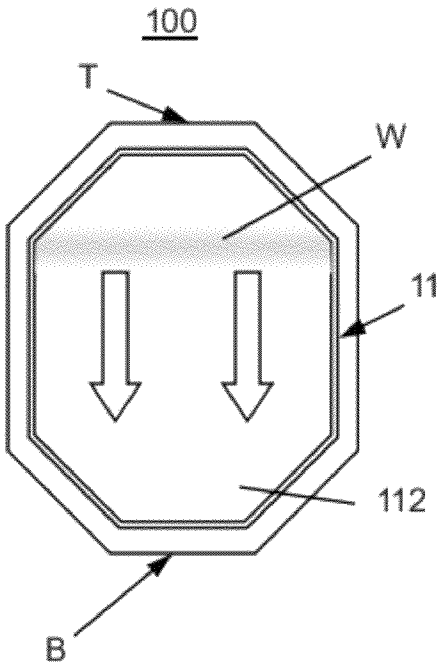
Figure 7C:
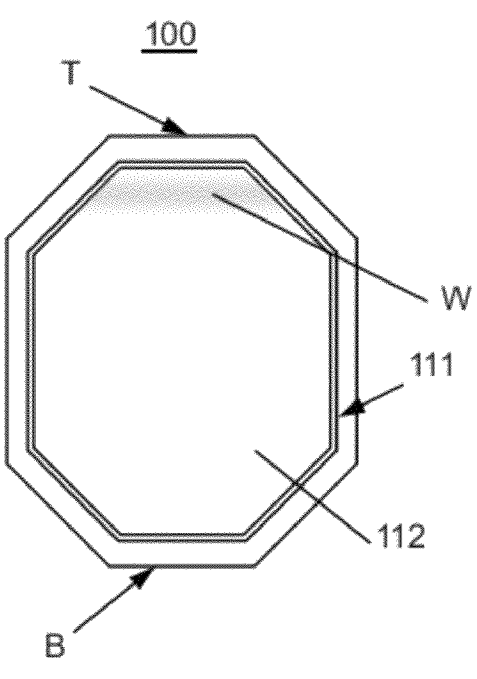

FIG. 7B shows the propagating shock wave front W at an interim location between the first end T and the second end B. The arrows indicate the propagation direction of the composite shock wave front W. FIG. 7C shows the shock wave front W near the second end B, after having propagated across the membrane 112 from the first end T. The propagating shock wave front W removes any ice crystals that may have formed on the surface of the membrane 112.

Referring back to FIG. 6, according to another embodiment, a second set of one or more membrane excitation points 116B can be provided near the second end B of the antenna 100. Using the second set of the membrane excitation points 116B, the propagation direction of the shock wave front W can be changed to from the second end B to the first end T. Alternatively, the propagation direction of the shock wave front W can be alternated from T to B and then from B to T, or vice versa. Similarly, it would be readily understood by one of ordinary skill in the art that the locations of the membrane excitation points can be changed so that the propagation direction of the shock wave front can be from side-to-side (i.e. orthogonal to the T to B or B to T directions).

According to yet another embodiment, the membrane excitation points in a given set of one or more membrane excitation points 116A, 116B can be excited sequentially. This sequential excitation of the one or more membrane excitation points in each of sets 116A, 116B can enhance the amplitude of the composite shock wave front W as the composite shock wave front W propagates. The appropriate timing of the sequential excitation of the membrane excitation points 116A, 116B is dependent on such parameters as the magnitude of the membrane excitation force applied, the physical properties of the membrane 112 that affect the velocity of the shock wave propagation in the membrane (e.g., thickness, elasticity, tension applied, etc.).

In the embodiment of FIG. 6, if pulses of pressurized air are used to deliver membrane excitation force, air inlet holes that can be controllably opened and closed may be associated with each of the membrane excitation points 116A, 116B.

Where the antenna aperture 111 has a complex configuration, parameters such as the number of the membrane excitation points, their location, the number of sets of membrane excitation points, the distance between the two or more sets of one or more membrane excitation points, the time delay between excitation of the two or more sets of one or more membrane excitation points, the magnitude and duration of the membrane excitation force applied, etc. can be varied to optimize the effectiveness of the propagating shock wave along the membrane for that particular configuration of the antenna aperture.

Each of the membranes 12, 112 covers the entire area of the antenna apertures 11, 111 and acts as an environmental seal that protects the antenna apertures 11, 111 from the environment.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention. For example, the two illustrated examples show an embodiment with one membrane excitation point and another embodiment with four membrane excitation points. However, one of ordinary skill in the art would readily recognize that the invention described herein is equally applicable to embodiments having different number of one or more membrane excitation points.

What is claimed is:

1. An ice-inhibition system for a radar or a communications antenna having an aperture, said ice-inhibition system comprising:

a membrane provided in front of said antenna aperture; and a first set of one or more membrane excitation points identified on the membrane, wherein when a first membrane excitation force is delivered to said first set of one or more membrane excitation points, a shock wave is generated at each of the one or more membrane excitation points and propagates along the membrane removing any ice formed on the surface of the membrane.

2. The ice-inhibition system of claim 1, further comprising a means for providing said first membrane excitation force.

3. The ice-inhibition system of claim 1, wherein said first membrane excitation force is delivered in an outward direction.

4. The ice-inhibition system of claim 3, wherein said first membrane excitation force is a pressurized pulse of air delivered at said one or more membrane excitation points.

5. The ice-inhibition system of claim 3, wherein said first membrane excitation force is an acoustic energy pulse.

6. The ice-inhibition system of claim 3, wherein said first membrane excitation force is a combination of a pressurized pulse of air and an acoustic energy pulse.

7. The ice-inhibition system of claim 3, wherein said first membrane excitation force is a mechanically delivered impact force.

8. The ice-inhibition system of claim 1, wherein said membrane is secured to the antenna along the antenna's perimeter region.

9. The ice-inhibition system of claim 1, further comprising a second set of one or more membrane excitation points identified on the membrane, wherein a second membrane excitation force is delivered to the second set of one or more membrane excitation points after the first membrane excitation force is delivered to said first set of one or more membrane excitation points.

10. An ice-inhibition system for a radar or communications antenna having an aperture, said ice-inhibition system comprising:

a membrane provided in front of said antenna aperture;

one or more membrane excitation points identified on the membrane; and a means for delivering a membrane excitation force to said one or more membrane excitation points, wherein when said membrane excitation force is delivered to the one or more membrane excitation points, a shock wave is generated at each of the one or more membrane excitation points and propagates along the membrane removing any ice formed on the surface of the membrane.

11. The ice-inhibition system of claim 10, wherein said membrane excitation force is delivered in an outward direction.

12. The ice-inhibition system of claim 11, wherein said means for providing membrane excitation force comprises a subwoofer speaker and said membrane excitation force is an acoustic energy pulse.

13. The ice-inhibition system of claim 11, wherein said means for providing membrane excitation force comprises a subwoofer speaker and said membrane excitation force is a combination of a pressurized pulse of air and an acoustic energy pulse.

14. The ice-inhibition system of claim 10, wherein said membrane is secured to the antenna along the antenna's perimeter region.

15. The ice-inhibition system of claim 10, further comprising a second set of one or more membrane excitation points identified on the membrane, wherein a second membrane excitation force is delivered to the second set of one or more membrane excitation points after the first membrane excitation force is delivered to said first set of one or more membrane excitation points.

* * * * *